US005122779A

United States Patent [19]

Lehmann et al.

[11] Patent Number: 5,122,779

[45] Date of Patent: Jun. 16, 1992

[54] STAGE PROGRAMMABLE LIGHT SEQUENCER FOR A TOY

[76] Inventors: Roger W. Lehmann, 18 Flintlock Ct., Bernardsville, N.J. 07924; Michael I. Satten, 4 Farmers Rd., Kings Point, N.Y. 11024

[21] Appl. No.: 392,100

[22] Filed: Aug. 10, 1989

[51] Int. Cl.[5] ..... G08B 1/00

[52] U.S. Cl. ..... 340/309.4; 340/321; 340/331; 340/478; 340/332; 315/200 A

[58] Field of Search ..... 340/309.4, 331, 478, 340/321, 332, 309.15; 315/200 A

[56] References Cited

U.S. PATENT DOCUMENTS

| | | | |
|---|---|---|---|
| 3,593,276 | 7/1971 | Schuler | 340/478 |
| 3,706,972 | 12/1972 | Okuhara | 340/478 |
| 3,747,063 | 7/1973 | Hudson, Jr. | 340/331 |

*Primary Examiner*—Donnie L. Crosland
*Attorney, Agent, or Firm*—Stoll, Previto & Hoffman

[57] ABSTRACT

A light sequencer for a toy having a simple way for individually varying the on and off times of each stage of a chain or ring. Each stage has a light controlling amplifier/switch whose gain is individually controlled by a hysteresis element. When the voltage across the hysteresis element is below its set breakdown voltage, it non-conducts, thereby causing the amplifier/switch to have negative gain, and the controlled light is not lit. When the voltage across a hysteresis element equals or exceeds its set breakdown voltage, it 'fires' into a highly-conductive state, causing the amplifier/switch to have very high gain, and the controlled light is lit. The hysteresis element remains in its conductive state until the voltage across it drops below recovery voltage level. Then it switches back to non-conductive state, causing the amplifier/switch to have negative gain, and the controlled light is not lit. The difference between breakdown or 'firing' voltage and recovery voltage is the hysteresis factor. Having hysteresis factor control gain of an amplifier/switch enables use of a simple Resistor-Capacitor circuit between the stages to control the on and off times of each stage in the chain, and the period time of the chain, or loop time of a ring. Varying resistor and capacitor values of each stage will cause a pseudo-random effect, thereby provoking greater interest on the part of the viewer.

11 Claims, 4 Drawing Sheets

DRIVE VOLTAGE CURVE B+ (11)

HYSTERISIS ELEMENT EQUIVALENT CIRCUIT

PROGRAMMABLE UNIJUNCTION THYRISTOR VERSION OF HYSTERISIS ELEMENT

STAGE PROGRAMMABLE LIGHT SEQUENCER FOR A TOY

BACKGROUND OF INVENTION

The present invention relates to a light sequencer for a toy, and more particularly one where low cost means enables each stage to be individually and differently programmed from any other.

PRIOR ART

Light sequencers in toys either involved oscillator-controlled shift registers, followed by latching switches, where each stage was limited to the identical time period of its neighbor, or some multiple thereof, or the shift register comprised a string of individually programmed 555 type of time-delay integrated circuits followed by latching switches.

The present invention eliminates the need for costly oscillators, latching switches, time-delay integrated circuits combined with latching switches. By using a hysteresis element to control the gain of an amplifier/-switch, a simple Resistor-capacitor circuit of almost any ratio can be used to set the time for each stage, and the circuit provides all the advantages of a latching switch, without the need or cost of them.

SUMMARY OF THE INVENTION

In a light sequencer for a toy, a plurality of lights is controlled individually and in groups, sequentially in ring structure, with individually programmably set on and off times controlled by simple resistor/capacitor circuits. Each stage has an input capacitor which capacitively couples its input to ground, and a drive-resistor through which it receives its positive and negative drive from the previous stage, or from a power supply. When the drive end of the drive-resistor is connected to a source of positive bias voltage, the voltage across the input capacitor slowly rises. When the drive end of the drive-resistor is then connected to ground, or a source of negative bias voltage, the voltage across the input capacitor slowly declines. This action of its own would produce a triangular shaped waveform whose rise and fall times are controlled by the R-C time constant of the input capacitor and the drive-resistor, which can be varied to control the period of the waveform. The slowly rising waveform is connected to the input of an amplifier/switch whose gain is controlled by a hysteresis element, and whose output is connected to a load element such as a resistor or light, as well as to the drive end of the drive-resistor of the next stage.

When the rising voltage across the input capacitor is below the firing or breakdown voltage of the hysteresis element, the gain of the amplifier/switch is negative, therefore it is nonconductive and provides no voltage to its load element or light. The drive end of the drive-resistor of the next stage now receives full positive bias through the load element or light of this stage.

Because the load element or light may demand anywhere from 10 milliamps (0.01 Amps.) through several amperes, and the drive current going through the drive-resistor anywhere from a nanoampere ($1\times10^{-9}$ Amps.) through ($n\times10-5$ Amps.) several microamperes, the ratio of load current to drive is always greater than 5000:1. Therefore the drive current is transparent to the load.

When the slowly rising voltage across the input capacitor exceeds the firing or breakdown voltage of the hysteresis element, it switches into a high-conduction state, thereby switching the amplifier/switch into its high gain conduction state, providing full voltage to the load element or light, and beginning negative bias to the drive end of the drive-resistor of the next stage, thereby causing decline in the voltage across the input capacitor of the next stage.

Because the gain of the amplifier/switch of the next stage is also controlled by a hysteresis element still in its high-conduction state, the load element or light of the next stage remains on, even with the voltage across its input capacitor in declination. This state continues, until its input capacitor voltage drops to just below the recovery voltage of the hysteresis element. At this point, the hysteresis element recovers to its non-conduction state, the amplifier/switch gain goes negative and non conductive, turning off the voltage to its load element or light. By this action however, the drive end of the drive-resistor of the stage following this one, now receives positive bias, which will eventually turn it on.

Because there is a delay between the time when the light of one stage turns off, and the next turns on, and when one turns on and the next one turns off, and each of the times can be made different by just varying the value of the drive-resistor or input capacitor of a particular stage, the operation of this toy is much more complex than its simple structure and low cost would lead one to expect.

PREFERRED EMBODIMENT

Figure 1:
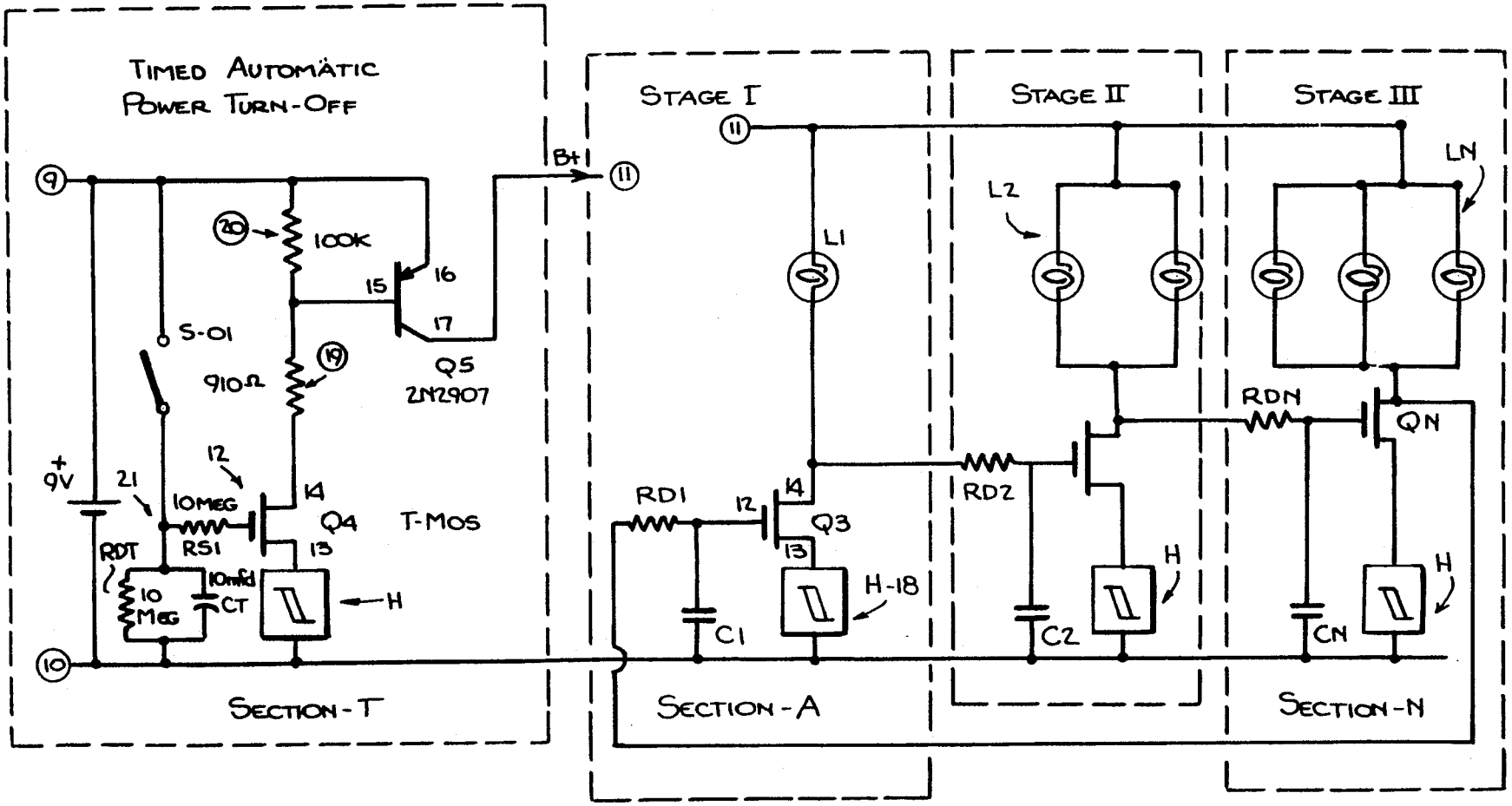
FIG. 1 is a schematic presentation of the preferred embodiment sectioned according to function.

Referring now to FIG. 1 there is shown a diagram of the basic elements of a stage programmable light sequencer for a toy. The negative terminal of the battery is connected to common terminal 10. Positive terminal of the battery is connected through terminal 9 of the timed automatic power turn-off to B+ terminal 11, or it may be directly connected to terminal 11, to provide the positive power supply, which is needed to power light sequencer sections-A through sections-N.

Referring now to Section A of FIG. 1 transistor $Q_3$ is a T-MOS field effect transistor having a gate 12 source 13 and drain 14. Drain 14 is connected to a supply of positive voltage at terminal 11 through a load circuit means which is designated in section A as $L_1$ lamp, however it is within the contemplation of the present invention that a plurality of lamps or resistors and LEDs can be used, as well as a bias resistor 19 used to control power switching transistor $Q_5$ of the timed automatic power turn-off of section T. The source 13 is connected to a supply of negative voltage at common terminal 10 through a hysteresis element H-18. The gate 12 is connected to common terminal 10 through input capacitor $C_1$ and to a source of drive voltage designated in FIG. 1 as the drain 14 of transistor $Q_N$ of section N through drive-resistor $RD_1$. The drain 14 which has just been described as driving the load means, is also the output terminal of section A and provides the source of drive voltage for the following stage through drive-resistor $RD_2$. Whereas the circuit configuration of each stage is the same as the ones preceeding and following it, it is within the contemplation of this invention to vary the number of lights of each stage, as well as the timing of each stage by varying the values assigned to the drive-resistor capacitor combinations of each stage.

PREFERRED EMBODIMENT CIRCUIT OPERATION

The T-MOS field effect transistors are being used as common source amplifiers. To the hysteresis element, however, they represent source followers providing voltage at low source impedance. The source to drain ON resistance of the T-MOS transistor can be as low as 0.5 Ohms. Its gate input impedance is a very high $10^5$ Ohms. So the RD-C circuit sees no load except itself. Because the drain load impedance is fixed, the voltage gain of each stage is totally controlled by the internal impedance of the hysteresis element which switches from essentially infinate resistance prior to firing, to very low (1.3 volts saturation voltage) after firing.

Figure 3:
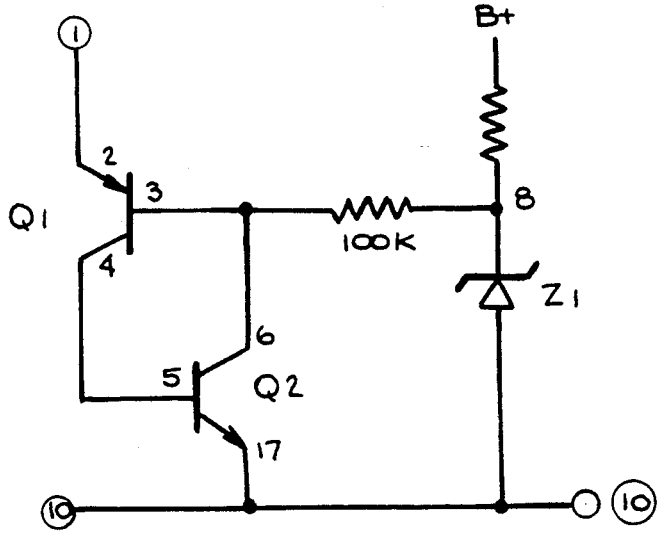
FIG. 3 is an equivalent circuit of any 4 layer thyristor device applied as a hysteresis element.

Referance is now made to the hysteresis element equivalent circuit shown in FIG. 3. For illustration purposes $Z_1$ provides +5 volts between terminal 8 and common terminal 10. The +5 volts is conducted to base 3 of PNP transistor $Q_1$ and collector 6 of NPN transistor $Q_2$ through a 100K Ohm biasing resistor. The +5 volts reverse biases the base-emitter junction of transistor $Q_1$ so there is no conduction between its collector 4 and the base 5 of transistor $Q_2$. Therefore both transistors are fully turned off. When the positive voltage between terminals 1 and 10 exceeds by 0.65 Volts (The forward voltage drop of the base-emitter diode of $Q_1$.) the reverse bias positive voltage between terminals 8 and 10, transistor $Q_1$ goes into conduction providing forward bias to base 5 of transistor $Q_2$, thereby turning it on. When transistor $Q_2$ turns on, its collector 6 both forward biases the base 3 of transistor $Q_1$, and clamps the reverse biasing positive voltage at the base of transistor $Q_1$ down to the saturation voltage of $Q_2$ (0.65 volts). Therefore the switching voltage between terminals 1 and 10 has been reduced from +5.65 volts to +1.3 volts. When the positive voltage between terminals 1 and 10 drops much below 1.3 volts. the forward voltage drop of the base-emitter junction of both transistors cannot be overcome, and the transistors stop conducting, thereby returning the reverse bias to +5 volts. The difference between the breakdown voltage of 5.65 volts and the recovery voltage of 1.3 volts is the hysteresis factor.

Figure 5:
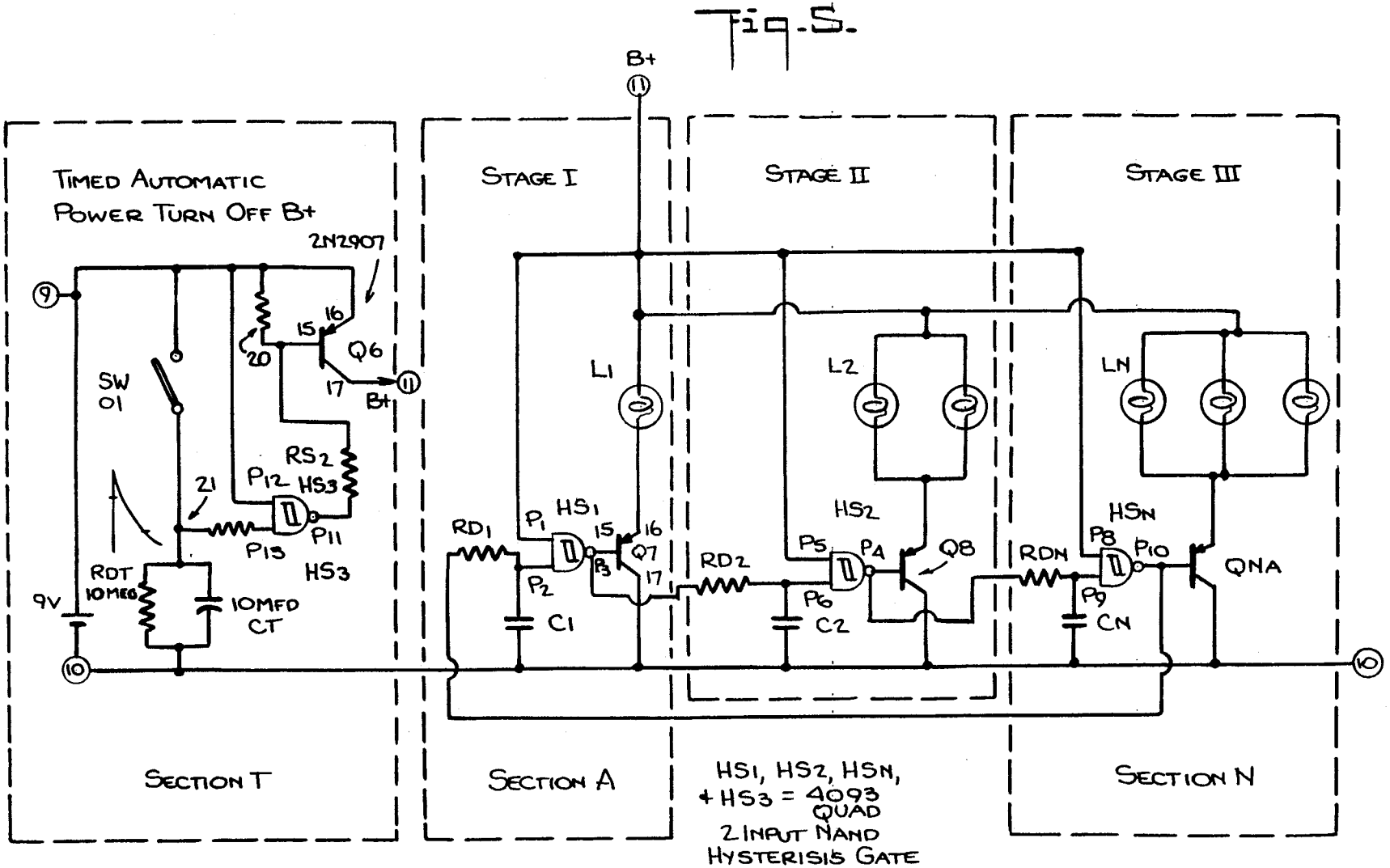
FIG. 5 is an alternate embodiment of the present invention sectioned correspondingly to FIG. 1.

Hysteresis factors can also be generated by using asymetrical flip-flops, and such has been contemplated in our alternate embodiment as illustrated in FIG. 5.

Any thyristor PNPN or NPNP device can be gated to produce a hysteresis element of exact breakdown and recovery voltage specifications. For reasons of brevity we are limiting our illustrations.

Figure 4:
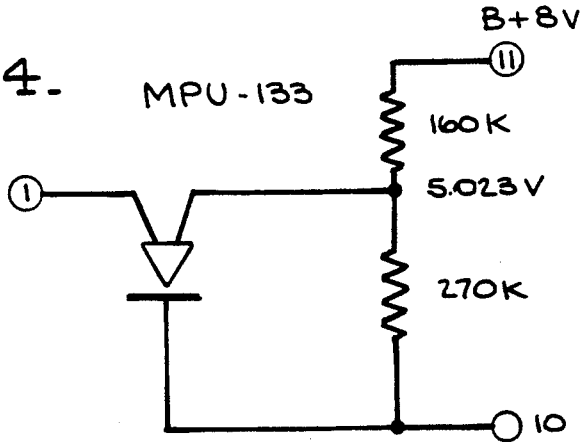
FIG. 4 is a schematic of a MPU thyristor device (programmable unijunction) applied as a hysteresis element.

FIG. 4 illustrates a programmable unijunction transistor thyristor version of the equivalent circuit of FIG. 3.

Figure 2:
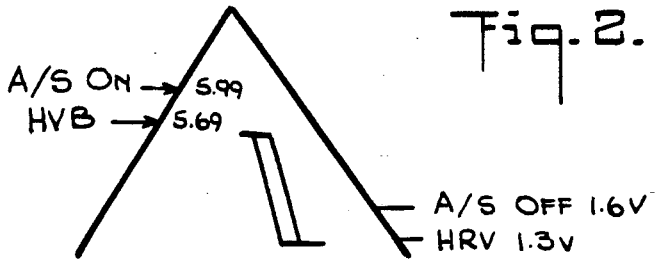
FIG. 2 is a graph display of the switching characteristics of a hysteresis element.

FIG. 2 is a relative display of the drive voltage curve that is seen by the input of each of the stages, then amplified and biased across the hysteresis element. HVP represents the high voltage breakdown point of the hysteresis element, and A/S ON the correspondingly slightly higher turn-on point of the amplifier/switch. HRV represents the low voltage recovery point of the hysteresis element, and A/S OFF the correspondingly slightly higher turn-off point of the amplifier/switch.

The hysteresis controlled amplifier/switch enables each stage to convert a triangular shaped waveform input into a sharp turn on sharp turn off time delay switch, with complete versatility in programability. Employing differing values of resistance for the drive-resistors of each stage, while maintaining constant input capacitance values, enables each stage to have a turn-on turn-off delay that differs from its neighbors. Shunting a drive-resistor with a diode will eliminate the time delay in one direction of that particular stage. For example; connecting the anode to the input of one stage, and the cathode to the drive point of the previous stage, will enable normal time delay for turn-on, but almost no delay for turn-off. Reversing the same diode enables almost no time delay for turn-on, but full delay for turn-off.

Reference is now made to FIG. 1. Section-A through section-N provides a plurality of time delay light switches, whereby section-A functions as stage I and drives the input of stage II. Stage II in turn drives the input of section-N which functions as stage III and drives the input of section-A which functions as stage I. Stage I is shown switching $L_1$, or one light. Stage II is shown switching $L_2$, or two lights, and stage III is shown switching $L_3$, or three lights. This is shown for illustration purposes only. It is within the scope of this invention for each stage to switch any number of lights, and for a plurality of any number of stages to be connected in series with each other or in any series parallel combination.

In FIG. 1, Section-T functions as an independant timed automatic power turn-off switch which controls the power to sections-A through Section-N.

It consists of a hysteresis element controlled amplifier/switch, whereby the load element is a forward biasing resistor 19 in series with the base 15 emitter 16 junction of PNP transistor $Q_5$. Resistor 20 shunting the base emitter junction of transistor $Q_5$ is there to shunt the collector base leakage current of transistor $Q_5$, and to provide reverse bias, in the absence of forward bias current through resistor 19, thereby enabling transistor $Q_5$ to completely turn off. The gate 12 of transistor $Q_4$ is connected through a protective current surge limiting resistor $RS_1$ to a parallel circuit of resistor RDT and capacitor CT. This shunts the gate 12 of transistor $Q_4$ to common terminal 10.

The negative polarity of a 9 volt battery is connected between common terminal 10 and input B+ terminal 9. Input B+ terminal 9 is also connected to emitter 16 of transistor $Q_5$, the emitter end of shunting resistor 20 and the drive end of activate switch S-01, which is normally open, but momentarily connects junction point 21 to input B+ terminal 9.

Operation of section-T is as follows: Switch S-01 is momentarily depressed, connecting junction point 21 to input B+ terminal 9 charging input capacitor CT to +9 volts. Source 13 of amplifier/switch $Q_4$ presents greater than 6 volts between the top of the hysteresis element H and common terminal 10. This causes the hysteresis element H to fire into its high conduction mode, thereby forward biasing the gate 12 source 13 of transistor $Q_4$ with +7.7 volts, completely switching on its source 13 drain 14 circuit. This connects forward bias resistor 19 to the top of the hysteresis element H which is now 1.3 volts above common terminal 10 representing a forward bias voltage relative to forward bias resistor 19 in series with the base 15 emitter 16 junction of PNP transistor $Q_5$ of 7.05 volts, thereby turning on the emitter 16 collector 17 junction of PNP transistor $Q_5$, thereby connecting B+ input terminal 9 to B+ terminal 11, thus providing power to operate section-A through section-N.

The instant switch S-01 is released, the B+ voltage across input capacitor CT begins to decay through resistor RDT until it drops to about 1.5 volts in about 2RC. At 1.5 volts $Q_4$ presents less than 1. 3 volts between the top of hysteresis element H and common terminal 10, causing it to recover to its nonconducting state, thereby turning off transistor $Q_4$, which no longer forward biases resistor 19 causing the base 15 emitter 16 junction of PNP transistor $Q_5$ to become negatively biased through resistor 20, and therefore turn off emitter 16 collector 17 junction of transistor $Q_5$. Thus disconnecting B+ input terminal 9 from B+ terminal 11, thereby turning off sections-A through section-N.

ALTERNATE EMBODIMENT

FIG. 5 has been sectioned and staged to correspond to FIG. 1. There is shown a diagram of the basic elements of a stage programmable light sequencer for a toy. The negative terminal of the battery is connected to common terminal 10. Positive terminal of the battery is connected through terminal 9 of the timed automatic power turn-off to B+ terminal 11, or it may be directly connected to terminal 11, to provide the positive power supply, which is needed to power light sequencer sections-A through sections-N.

The hysteresis elements of FIG. 5, noted as $HS_3$, $HS_1$, $HS_2$ and $HS_N$ are all part of a single No. '4093' quad two-input NAND hysteresis gate integrated circuit. The reason for selecting this particular integrated circuit hysteresis device, is that it is very commonly available off the shelf for computer applications. Each of the four elements making up the quad, consists of a 2-input NAND gate which drives a hysteresis factored flip-flop which drives an output switch. It works as follows: When both NAND inputs are high (This means B+ biased above operating threshold.), the output is low (This means the output switch is ON, and connects the output to common.). Any other combination of conditions for the two inputs, results in a high (The output switch is OFF, connecting the output terminal to B+ through an internal output resistor.). Each of the two inputs is identical, and addresses the hysteresis factor illustrated in FIG. 2.

Because this invention only requires the use of a single hysteresis device per. stage, the first input of each element is permanently biased high (Tied to B+.) to enable the second input of each element to operate exactly as illustrated in FIG. 2. Either of the two inputs may be selected to be first or second inputs.

Referring now to Section A of FIG. 5. $HS_1$ is a 2 input NAND hysteresis gate, having a first input P1 a second input P2 and an output P3. First input P1 is permanently connected to B+. Output P3 is connected to a supply of positive voltage at terminal 11 through an internal bias resistor, in parallel with an external circuit comprising the base 15 emitter 16 junction of PNP transistor $Q_7$ in series with lamp $L_1$. However, it is within the scope of the present invention that a plurality of lamps or resistors and LEDs can be used. Outputs may be used to directly drive power switching transistors, or may be used to drive bias resistors such as $RS_2$ used to control power switching transistor $Q_5$ of the timed automatic power turn-off of section T.

Input P2 is connected to common terminal 10 through input capacitor $C_1$ and to a source of drive voltage designated in FIG. 5 as the output P10 of element $HS_N$ of section N through drive-resistor $RD_1$. The output P3 which has just been described as driving the Base emitter junction of PNP transistor $Q_7$ is also the output terminal of stage-I section A and provides the source of drive voltage for the following stage through drive-resistor $RD_2$. Whereas the circuit configuration of each stage is the same as the ones preceeding and following it, it is within the contemplation of this invention to vary the number of lights of each stage, as well as the timing of each stage by varying the values assigned to the drive-resistor capacitor combinations of each stage.

ALTERNATE EMBODIMENT CIRCUIT OPERATION

FIG. 2 is a relative display of the drive voltage curve that is seen by the input of each of the stages, then amplified and operated on by the hysteresis factor of the flip-flop. HVP represents the high voltage breakdown and switch-on point of the hysteresis factor asymetrical flip-flop. HRV represents the low voltage recovery point of the hysteresis factor asymetrical flip-flop.

The hysteresis factor of the flip-flop enables each stage to convert a triangular shaped waveform input into a sharp turn on sharp turn off time delay switch, with complete versatility in programability. Employing differing values of resistance for the drive-resistors of each stage, while maintaining constant input capacitance values, enables each stage to have a turn-on turn-off delay that differs from its neighbors. Shunting a drive-resistor with a diode will eliminate the time delay in one direction of that particular stage. For example; connecting the anode to the input of one stage, and the cathode to the drive point of the previous stage, will enable normal time delay for turn-on, but almost no delay for turn-off. Reversing the same diode enables almost no time delay for turn-on, but full delay for turn-off.

How hysteresis factors can be generated with asymetrical flip-flops, is shown below. And such has been contemplated in our alternate embodiment as illustrated in FIG. 5. Integrated circuit No. 4093 is normally referred to as a quad two-input NAND hysteresis gate. For the purpose of analysis FIG. 6 is a fully designed 2-input NAND hysteresis gate asymetrical flip-flop.

Figure 6:
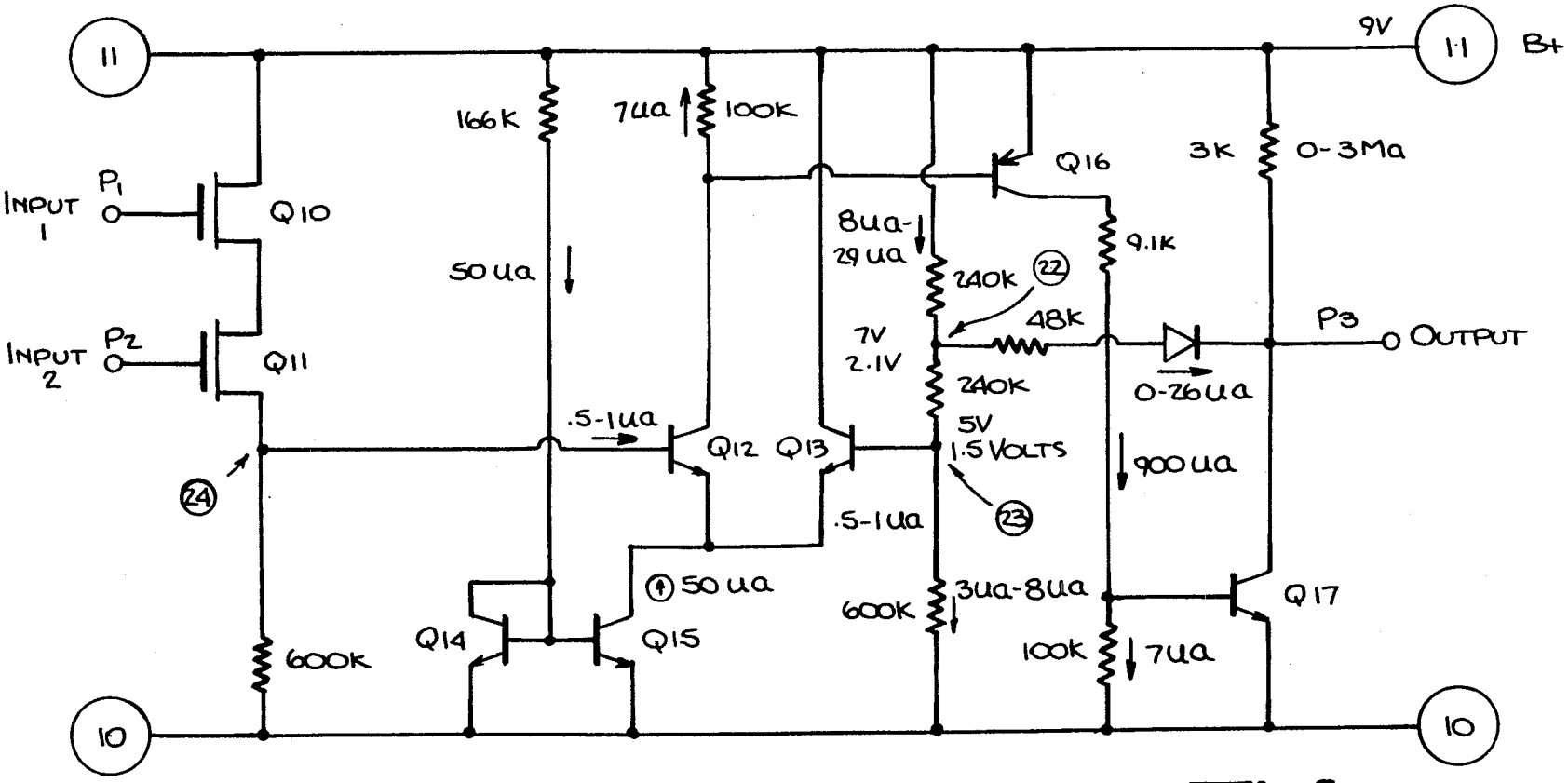
FIG. 6 is a fully designed 2-input NAND hysteresis gate asymetrical flip-flop, which completely conforms with the specifications of this disclosure, and is pinned in conformance with element one of the No. 4093 quad..

Refering to FIG. 6, we find that a NAND input circuit is really and AND circuit where the output of the entire package is polarity inverted with respect to the input.

$Q_{10}$ and $Q_{11}$ are enhanced N channel field effect transistors whereby the drain of $Q_{10}$ is connected to B+ terminal 11 and its source is series connected to the drain of $Q_{11}$, and the source of $Q_{11}$ is connected to common terminal 10 through a 600K ohm resistor. To have an output at point 24, the input gates of both these transistors must be positive at the same time. Because when a gate is not positive, there is no conduction between its associated drain and source. When the gate of only one transistor is positive, only its drain to source is conductive, leaving the drain to source of the remaining series transistor nonconductive, and thereby not permitting the flow of current between B+ terminal 11 and point 24. When both input gates are tied to B+ terminal 11 at the same time, their respective drain to source circuits are conductive at the same time, thereby conducting all the voltage from B+ terminal 11 to point 24. If the gate of one of these transistors is tied to B+ terminal 11 its drain to source is fully conductive (shorted). If at the same time the gate of the second transistor is now connected to a generator of variable lower voltage B+, that transistor acts as an analog source follower, providing very high current gain, but somewhat less than unity voltage gain between its gate and point 24. Therefore, if input 1 is tied to B+ terminal 11, and input 2 sees the voltage illustrated in FIG. 2, the source of transistor $Q_{11}$ will generate the same waveform at a low source impedance at point 24, but at slightly less than unity voltage gain.

NPN transistors $Q_{12}$ and $Q_{13}$ are a matched pair configured as a differential amplifier. Their emitters are tied together to a 50 microamp constant current sink. NPN transistors $Q_{14}$ and $Q_{15}$ are a matched pair configured as a current mirror, with transistor $Q_{15}$ acting as a precise 50 microamp current sink. A voltage divider is configured, comprising a 240K resistor connected between B+ terminal 11 and point 22, in series with a second 240K resistor between points 22 and 23 and a 600K ohm resistor between point 23 and common terminal 10. Point 22 is also connected to output terminal P3 through a 48K ohm resistor in series with a diode.

The collector of transistor $Q_{12}$ is also connected to B+ terminal 11 through the base-emitter junction of PNP transistor $Q_{15}$ in parallel with a 100K ohm negative bias resistor.

When the emitter-collector junctions of transistor $Q_{12}$ conducts, it forward biases PNP transistor $Q_{15}$, causing conduction between its emitter-collector junction, which is connected to common terminal 10 through a 9.1K ohm resistor in series with the base-emitter junction of NPN transistor $Q_{17}$ in parallel with a 100k ohm negative bias resistor. Thus forward biasing and turning NPN transistor $Q_{17}$ on. When NPN transistor $Q_{17}$ is turned on, it provides a short circuit between output terminal P3 and common terminal 10. This also serves to short point 22 to common terminal 10 through a 48K ohm resistor and series diode, thereby clamping point 22 down to 2.1 volts, and the base of transistor $Q_{13}$ down to +1.5 volts at point 23.

Stated somewhat differently, when input 1 at point P1 is clamped to B+ terminal 11, and input 2 at P2 is at zero voltage input, there is no voltage at point 24, the base input of $Q_{12}$. The above cited voltage divider therefore provides +5 volts to the base of transistor $Q_{13}$ at point 23. This causes the emitter of transistor $Q_{13}$ to present +4.35 volts to the emitter of transistor $Q_{12}$ thereby reverse biasing its base emitter junction. For input 2 to overcome this reverse bias, would require greater than +5.4 volts at P2. As long as $Q_{12}$ is reverse biased off, transistor $Q_{15}$ receives no forward bias, and is clamped off through the 100K ohm negative bias resistor at its base, and therefore $Q_{17}$ also receives no forward bias at its base, and is clamped off through the 100K ohm negative bias resistor. Since transistor $Q_{17}$ is now clamped off, B+ terminal 11 is connected to output terminal P3 through a 3K ohm resistor, and the output at P3 is said to be high. When the output at P3 is in high mode its unloaded output voltage is +9 volts. Since the B+ voltage at point 22 is +7 volts the diode connecting point 22 to point P3 is reverse biased by 2 volts and remains nonconducting. Therefore the input voltage at the base of transistor $Q_{13}$ is +5 volts its emitter presenting +4.35 volts of reverse bias to the emitter of transistor $Q_{12}$.

When the waveform shown in FIG. 2 is presented at input 2, and point P2 reaches HVB of +5.69 volts, the base of $Q_{12}$ becomes biased at +5.4 volts, or +0.4 volts higher than the base of $Q_{13}$, thereby turning on $Q_{12}$ and reverse biasing $Q_{13}$. When $Q_{12}$ turns on, its collector forward biases the base-emitter junction of PNP transistor $Q_{15}$, turning its emitter-collector junction on, thereby forward biasing the base-emitter junction of transistor $Q_{17}$, turning it on. When transistor $Q_{17}$ turns on, it clamps output terminal P3 to common terminal 10 and also shorts point 22 through the 48K ohm resistor in series with the diode to common terminal 10, thereby reducing the B+ voltage at point 22 from 7 volts to 2.1 volts. This reduces the voltage at the base of transistor $Q_{13}$ from +5 volts to +1.5 volts. Thereby producing the asymetery and hysteresis factor.

The emitter of transistor $Q_{13}$ would now like to present +0.85 volts to the emitter of $Q_{12}$. This cannot happen however because they share a constant current sink which is now captured by transistor $Q_{12}$. This condition will persist until the input waveform of FIG. 2 drops to HRV. At this point the 1.5 volts at point 23 exceeds the 1 volt at point P24 and the emitter of $Q_{13}$ captures the shared constant current sink, turning $Q_{12}$ off. When $Q_{12}$ turns off, $Q_{15}$ and $Q_{17}$ follow. Raising output P3 to high and returning the voltage at the base of transistor $Q_{13}$ to +5 volts.

Figure 7:
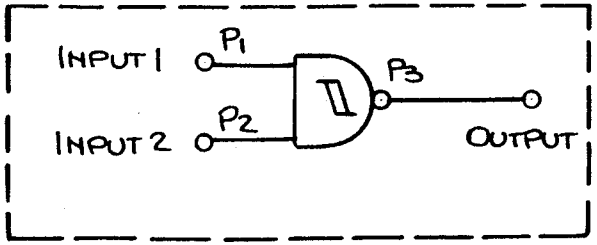
FIG. 7 is a pinned illustration of element one of the No. 4093 quad. utilized in the alternate embodiment of this invention.

FIG. 7 is the symbolic representation of element one of the No. 4093 quad. which is pinned and functions correspondingly to the above. All four elements of the quad are identical to each other.

Reference is now made to FIG. 5. Section-A through section-N provides a plurality of time delay light switches, whereby section-A functions as stage I and drives the input of stage II. Stage II in turn drives the input of section-N which functions as stage III and drives the input of section-A which functions as stage I. Stage I is shown switching $L_1$, or one light. Stage II is shown switching $L_2$, or two lights, and stage III is shown switching $L_3$, or three lights. This is shown for illustration purposes only. It is within the scope of this invention for each stage to switch any number of lights, and for a plurality of any number of stages to be connected in series with each other or in any series parallel combination.

In FIG. 5, Section-T functions as an independant timed automatic power turn-off switch which controls the power to sections-A through Section-N. It consists of a hysteresis gate controlled amplifier/switch, whereby the load element of the hysteresis gate HS3, is a forward biasing resistor RS2 in series with the base 15 emitter 16 junction of PNP transistor $Q_5$. Resistor 20 shunting the base emitter junction of transistor $Q_5$ is there to shunt the collector base leakage current of transistor $Q_5$, and to provide negative bias, in the absence of the forward bias current through resistor RS2, thereby enabling transistor $Q_5$ to completely turn off.

Input P13 of gate HS3 is connected through a protective current surge limiting resistor RS1 to a parallel circuit of resistor RDT and capacitor CT. This shunts the input P13 of gate HS3 to common terminal 10.

The negative polarity of a 9 volt battery is connected between common terminal 10 and input B+ terminal 9. Input B+ terminal 9 is also connected to emitter 16 of transistor $Q_5$, the emitter end of shunting resistor 20 and the drive end of activate switch S-01, which is normally open, but momentarily connects junction point 21 to input B+ terminal 9.

The moment Switch S-01 is depressed, it connects junction point 21 to input B+ terminal 9 charging input capacitor CT to+9 volts. The hysteresis gate HS3 analysed as FIG. 6 above, is caused to fire into its low or on mode, shorting output point P11 to common terminal 10. This connects forward bias resistor RS2 in series with the base 15 emitter 16 junction of PNP transistor $Q_5$ to a forward bias voltage source which for PNP transistor $Q_5$, is common terminal 10. This turns on the emitter 16 collector 17 junction of PNP transistor $Q_5$, and thereby connects B+ input terminal 9 to B+ terminal 11. Thus providing power to operate section-A through section-N.

The instant switch S-01 is released, the B+ voltage across input capacitor CT begins to decay through resistor RDT until it drops to about 1.6 volts in about 2RC. At 1.5 volts and below, the hysteresis gate described as FIG. 6 above recovers into its high state, causing output P11 to disconnect forward bias resistor RS2 from common terminal 10, thereby turning off the base 15 emitter 16 junction of PNP transistor $Q_5$ to become negatively biased through resistor 20. Thus turning off emitter 16 collector 17 junction of transistor $Q_5$, disconnecting B+ input terminal 9 from B+ terminal 11, thereby turning off sections-A through section-N.

Operation of section-A through Section-N follows. As stipulated above, the negative polarity of a 9 volt battery is connected to common terminal 10. The positive polarity is connected to B+ terminal 11, either through section-T or directly.

When B+ is connected to positive terminal 11, all the hysteresis gates, amplifier/switches and associated loads and/or lights are in off condition. The input capacitors of all of the stages begin to accumulate a positive charge through their connected drive-resistors. The stage having the shortest R-C time constant will reach the firing voltage of its hysteresis gate $HS_x$ first, and thereby turn on its output (to low), and its associated amplifier/switch and light first. Since this invention features complete programmability, this could be any stage. For ease of analysis we will elect stage I to turn on first.

When stage I turns on, a positive voltage charge remains in the input capacitors of stages II and III. Stage III continues charging through $RD_n$ and $L_2$, and stage I continues to receive positive bias through $RD_1$ and $L_n$. Stage II's input capacitor however, begins discharging through $RD_2$, and a low output of HS1 which connects the drive side of $RD_2$ to common terminal 10. Thus precluding the firing of stage II. Stage III however, continues charging through $RD_n$ and $L_2$ until the voltage accumulated across input capacitor $C_n$ is sufficient to cause input gate P9 of HSN to fire thereby turning on amplifier/switch $Q_n$, its lights $L_n$ and causing the input capacitor $C_1$ of stage I to discharge through drive-resistor $RD_1$, and the low output of HSN of stage III. When the voltage across input capacitor $C_1$ of stage I drops below about 1.5 volts, the output P3 of Hysteresis gate HS1 of stage I recovers to high (off) thereby turning off transistor $Q_7$ of stage I, and its lights $L_1$. Since output P3 is now off, and in high mode, its output voltage rises to the voltage present at B+ terminal 11. This causes input capacitor $C_2$ to charge through drive-resistor $RD_2$ until it reaches A/S-on. The voltage required for input P6 of stage II to fire its output P4 into saturation. Thus turning on the amplifier/switch of stage II, its lights $L_2$, and causing input capacitor $C_n$ of stage III to discharge through drive-resistor $RD_n$ and stage II. When the voltage across input capacitor $C_n$ of stage III drops below about 1. 6 volts, the hysteresis factor causes output P10 to turn off, recovering to high. Thereby turning off transistor $Q_n$ of stage III, and its lights $L_3$. Output P10 recovering to high, also causes input capacitor $C_1$ to begin charging through drive resistor $RD_1$, beginning the cycle all over again.

The cycle continues until B+ voltage is removed from B+ terminal 11 through section-T or other means.

What is claimed is:

1. A light sequencer for a toy comprising in combination: a plurality of cooperatively coupled stages, each stage comprised of: a hysteresis controlled amplifier switch having an input serially connected to the output of a drive resistor-capacitor time lag network, said drive resistor-capacitor time lag network producing a triangularly shaped waveform, and an output of said hysteresis controlled amplifier switch connected to a load wherein at least one of a drive resistor driving the next one of said plurality of cooperatively coupled stages, and a light emitting means comprises said load.

2. The light sequencer of claim 1 wherein the resistor and capacitor of said input resistor-capacitor time lag network are connected in parallel with each other at said input of said stage, and said input is momentarily connected to a source of B+ voltage through a momentary contact switch.

3. The light sequencer of claim 2 wherein said output is used to control the supply of B+ voltage to a plurality of said circuits.

4. The light sequencer of claim 1 wherein the resistor of the resistor-capacitor time lag network is a variable resistor.

5. The light sequencer of claim 1 wherein the resistance value of the resistor of the resistor-capacitor time lag network differs from stage to stage.

6. The light sequencer of claim 1 wherein the capacitance value of the capacitor of the resistor-capacitor time lag network differs from stage to stage.

7. The light sequencer of claim 1 wherein the light comprises a plurality of lamps of L.E.D.s.

8. In a light sequencer for a toy comprising a plurality of hysteresis controlled amplifier switches, each hysteresis controlled amplifier switch having an input serially connected to the output of a drive resistor-capacitor time lag network, said drive resistor-capacitor time lag network producing a triangularly shaped waveform, an output of said hysteresis controlled amplifier switch coupled to a drive resistor of a resistor-capacitor time lag network of a following stage, and to a load comprising light emitting means.

9. The light sequencer of claim 8 wherein the light comprises a plurality of lamps or L.E.D.s.

10. A light sequencer for a toy comprising in combination: a plurality of coupled stages, each stage comprising a hysteresis controlled amplifier switch having an input, said input being serially coupled to the output of a drive resistor-capacitor time lag network, said drive resistor-capacitor time lag network producing a triangularly shaped waveform, and an output of said hysteresis controlled amplifier switch, said output being connected to a load comprising at least one of a drive resistor driving the next one of said plurality of cooperatively coupled stages, and a light emitting means.

11. In a light sequencer for a toy comprising a plurality of hysteresis controlled amplifier switches, each hysteresis controlled amplifier switch having an input serially connected to the output of a drive resistor-capacitor time lag network, said drive resistor-capacitor time lag network producing a triangularly shaped waveform, an output of said hysteresis controlled amplifier switch coupled to a load wherein said load comprises at least one of at least one drive resistor, of at least one drive resistor-capacitor time lag network of at least one following stage, and a light emitting means.

* * * * *